US005891308A

United States Patent [19]

Skaugen

[11] Patent Number: 5,891,308

[45] **Date of Patent: *Apr. 6, 1999**

[54] METHOD OF PRESSING A PAPER WEB OF TROPICAL HARDWOOD FIBERS

[75] Inventor: Borgeir Skaugen, Beloit, Wis.

[73] Assignee: Beloit Technologies, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 597,521

[22] Filed: Feb. 2, 1996

[51] Int. Cl.[6] ..... D21F 3/04

[52] U.S. Cl. ..... 162/205; 162/358.3; 162/360.3

[58] Field of Search ..... 162/358.3, 360.2, 162/360.3; 164/205

[56] References Cited

U.S. PATENT DOCUMENTS

| | | | |
|---|---|---|---|
| 3,861,996 | 1/1975 | Dorfel | 162/360.3 |
| 3,861,997 | 1/1975 | Ely | 162/360 |
| 4,075,056 | 2/1978 | Ely et al. | 162/305 |
| 4,086,131 | 4/1978 | Rempel et al. | 162/203 |
| 4,197,158 | 4/1980 | Johnson | 162/305 |
| 4,257,844 | 3/1981 | Schmitt et al. | 162/305 |
| 4,483,745 | 11/1984 | Wicks et al. | 162/205 |
| 4,556,451 | 12/1985 | Ely | 162/205 |
| 4,561,939 | 12/1985 | Justus | 162/360 |
| 4,704,192 | 11/1987 | Cronin | 162/360.1 |
| 4,915,790 | 4/1990 | Dahl | 162/360.2 |
| 5,240,563 | 8/1993 | Karvinen et al. | 162/274 |
| 5,256,257 | 10/1993 | Schiel | 162/360.3 |
| 5,269,885 | 12/1993 | Tavi | 162/358.1 |
| 5,308,450 | 5/1994 | Braun et al. | 162/360.2 |
| 5,368,697 | 11/1994 | Steiner et al. | 162/360.2 |
| 5,468,349 | 11/1995 | Schiel | 162/358.3 |

FOREIGN PATENT DOCUMENTS

| | | | |
|---|---|---|---|
| 2126617 | 12/1994 | Canada . | |
| 2137432 | 6/1995 | Canada | 162/360.3 |
| 0547816A1 | 6/1993 | European Pat. Off. . | |
| 0 657 579 A | 6/1995 | European Pat. Off. . | |
| 9206340 | 9/1992 | Germany | 162/360.2 |
| WO 93 12289 A | 6/1993 | Germany . | |
| 4321404 | 9/1994 | Germany | 162/360.3 |
| 1 381 360 | 1/1975 | United Kingdom . | |

OTHER PUBLICATIONS

"Beloit Tri–Nip™ Press", brochure, Beloit Corporation, Beloit, Wisconsin undated.

"Beloit Twinver Press", flyer, Beloit Corporation, Beloit, Wisconsin undated.

*Primary Examiner*—Karen M. Hastings

*Attorney, Agent, or Firm*—Lathrop & Clark LLP

[57] ABSTRACT

A press section is provided for a papermaking machine having an Extended Nip press before a conventional press section such as a Beloit Corporation Tri-Nip or Twinver press. A Beloit Corporation Extended Nip® press or similar type press, preferably of the closed blanket type, is installed before a conventional two or three nip press and thus reduces the problem of the web sticking to the center roll in the conventional press. The use of an Extended Nip press in front of a conventional pressing section can also increase the bulk of the web being formed. The pressing section of this invention is particularly useful for pressing webs formed of 100 percent tropical hardwood fibers which contain resinous particles which can cause problems in sticking to the center roll.

2 Claims, 3 Drawing Sheets

METHOD OF PRESSING A PAPER WEB OF TROPICAL HARDWOOD FIBERS

FIELD OF THE INVENTION

The present invention relates to methods of pressing paper webs in general and to methods of pressing paper webs of tropical hardwood fibers using an extended nip press in advance of a traditional center roll press section.

BACKGROUND OF THE INVENTION

Paper is manufactured on a papermaking machine as a continuously formed web of paper. A papermaking machine has a wet end where the web is formed by depositing paper forming fibers from a dilute stock of fibers suspended in water. The fibers are deposited onto a forming section or screen in what is known as the forming process. Water is removed from the forming wires by drainage through these screens which is often aided by suction boxes located beneath the forming wire.

As the web leaves the forming wires it passes beneath a suction pick-up roll. The web leaves this roll and the forming section containing approximately 20 percent fiber by weight and enters the press section of the papermaking machine. In the press section of the papermaking machine the paper web fiber content is increased to a level of about 40–50 percent fiber by weight by pressing the web to remove water. From the press section the web enters the drying section where a series of steam heated dryer rolls dry the paper to about 95 percent fiber by weight. After the paper has passed through the drying section the web is subjected to one or more calenders to smooth and improve the surface finish of the web. The web is then wound into a reel for removal from the papermaking machine.

The press section of a papermaking machine is typically composed of two or three nips, and may employ a third nip of the Extended Nip press type. An Extended Nip press employs a concave shoe which engages a blanket and the web against an opposed roll. A lubricant film is disposed between the blanket and the shoe which supports the blanket in its passage through the Extended Nip press. The nip of an Extended Nip press is typically about ten inches wide and the backing roll is in some configurations heated to between 300 and 700 degrees Fahrenheit.

A particular papermaking machine will often need to be designed to produce a particular or narrow range of paper types from a particular stock. One type of stock which can be particularly difficult to work with is stock make from 100 percent tropical hardwoods. Although temperate forests are dominated by just a few species of trees, tropical forests contain a large number of different species which invariably must be harvested together. Even where managed forests are harvested, a large number of tropical hardwoods species will typically be grown together to maintain a diverse ecosystem and minimize the susceptibility of the forest to disease and insect damage. Thus the properties of tropical hardwoods pulp can be difficult to characterize. Tropical hardwood pulp contains a fair amount of resinous particles which can cause problems in the drying section of a papermaking machine. A web formed from tropical hardwood fibers can stick excessively to the press rolls. The tropical hardwood pulp fibers are weak and this can increase the number of web breaks experienced in a typical machine day.

What is needed is a pressing section for a papermaking machine designed to improve the performance of a papermaking machine working with selective paper forming stocks including 100 percent tropical hardwood fibers.

SUMMARY OF THE INVENTION

The papermaking machine of this invention utilizes a pressing section with an Extended Nip press before a conventional press section such as a Tri-Nip™ press or Twinver™ press such as supplied by Beloit Corporation of Beloit, Wis. A Beloit Corporation Extended Nip® press or similar concave shoe press, preferably of the closed blanket type, is installed before a conventional two or three nip press to reduce the problem of the web sticking to the center roll in the conventional press. The use of an Extended Nip press in front of a conventional pressing section can also increase the bulk of the web being formed. Because the web still has a high water content the hydrodynamic forces of the water in the web prevent compaction of the web as it transits the nip of the Extended Nip press. The nip of the Extended Nip press also increases the dryness of the web as it wraps onto the center roll of the conventional pressing section. Greater dryness reduces sticking of the web. Because the web sticks less tightly to the center roll it can be removed with less tension which results in less stretching and thus greater bulk in the formed web. The lower water content of the web as it enters the conventional pressing section means that the conventional pressing section can use lower nip loads for a given amount of water removal if the web has been pre-pressed in an Extended Nip press before reaching the conventional press. Lower nip loads in the conventional press reduce sticking to the center roll and also reduce two-sidedness by reducing nip loading against the center roll. The pressing section of this invention is particularly useful for pressing webs formed of 100 percent tropical hardwood fibers which contain resinous particles which can cause problems in sticking to the center roll.

It is a feature of the present invention to provide a drying section for a papermaking machine which produces a web of greater bulk and stiffness.

It is a further feature of the present invention to provide a drying section for a papermaking machine which subjects the web to less stretching.

It is a another feature of the present invention to provide a press section of a papermaking machine wherein the web has less tendency to stick to the press roll.

It is yet another feature of the present invention to provide a pressing section in a papermaking machine which increases the potential for producing a web which responds to calendering with better smoothness and gloss.

It is also a feature of the present invention to provide a press section of a papermaking machine wherein a greater percentage of filler formed with the web is retained through the pressing section in the web.

It is an additional feature of the present invention to provide a method of pressing suitable for use with stock containing one-hundred percent tropical hardwood fibers.

It is a yet further feature of the present invention to provide a pressing section for a papermaking machine producing a more one-sided paper.

Further objects, features and advantages of the invention will be apparent from the following detailed description when taken in conjunction with the accompanying drawings.

DESCRIPTION OF THE PREFERRED EMBODIMENTS

Figure 1:
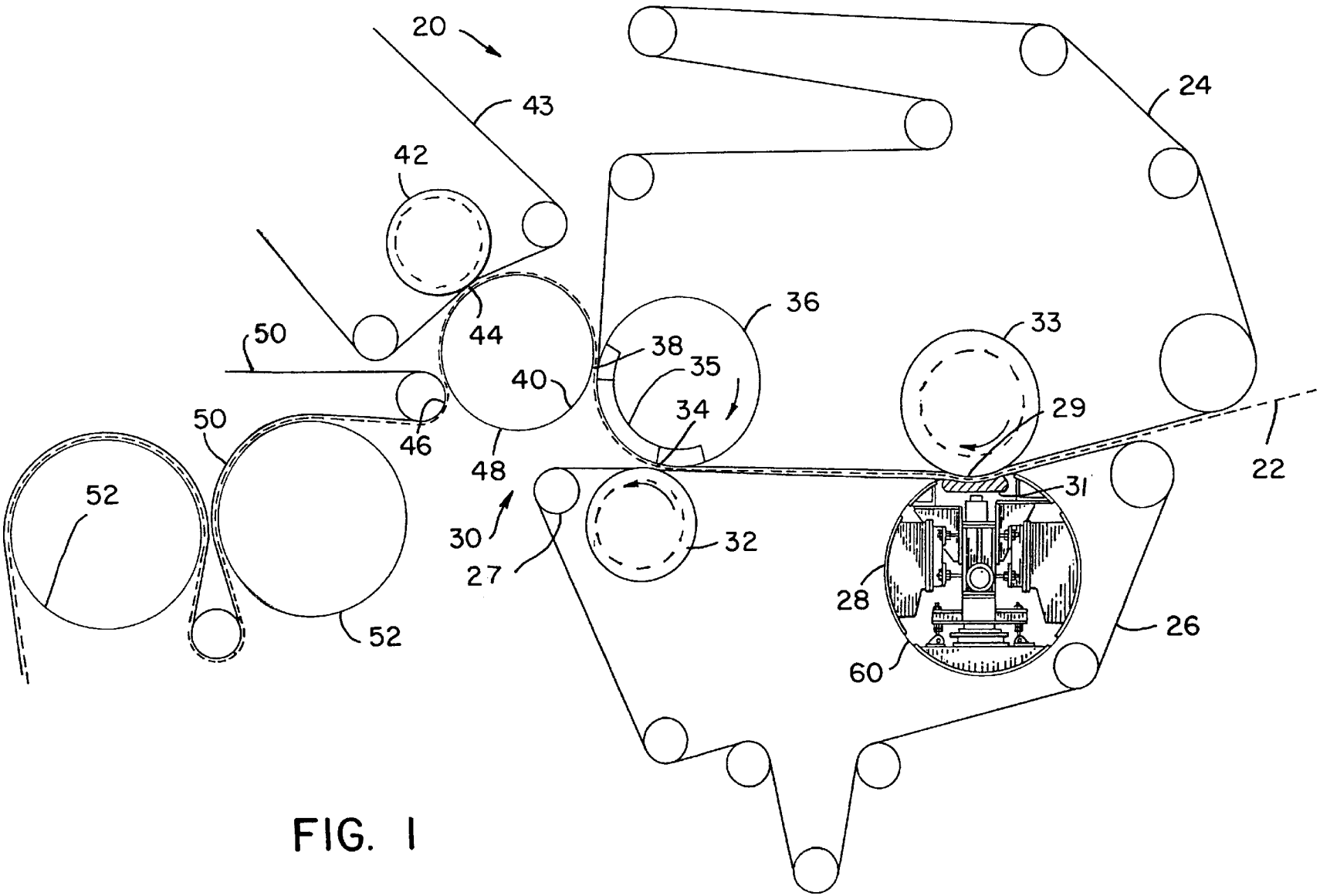
FIG. 1 is a schematic view of a pressing section of a papermaking machine of this invention.
Figure 2:
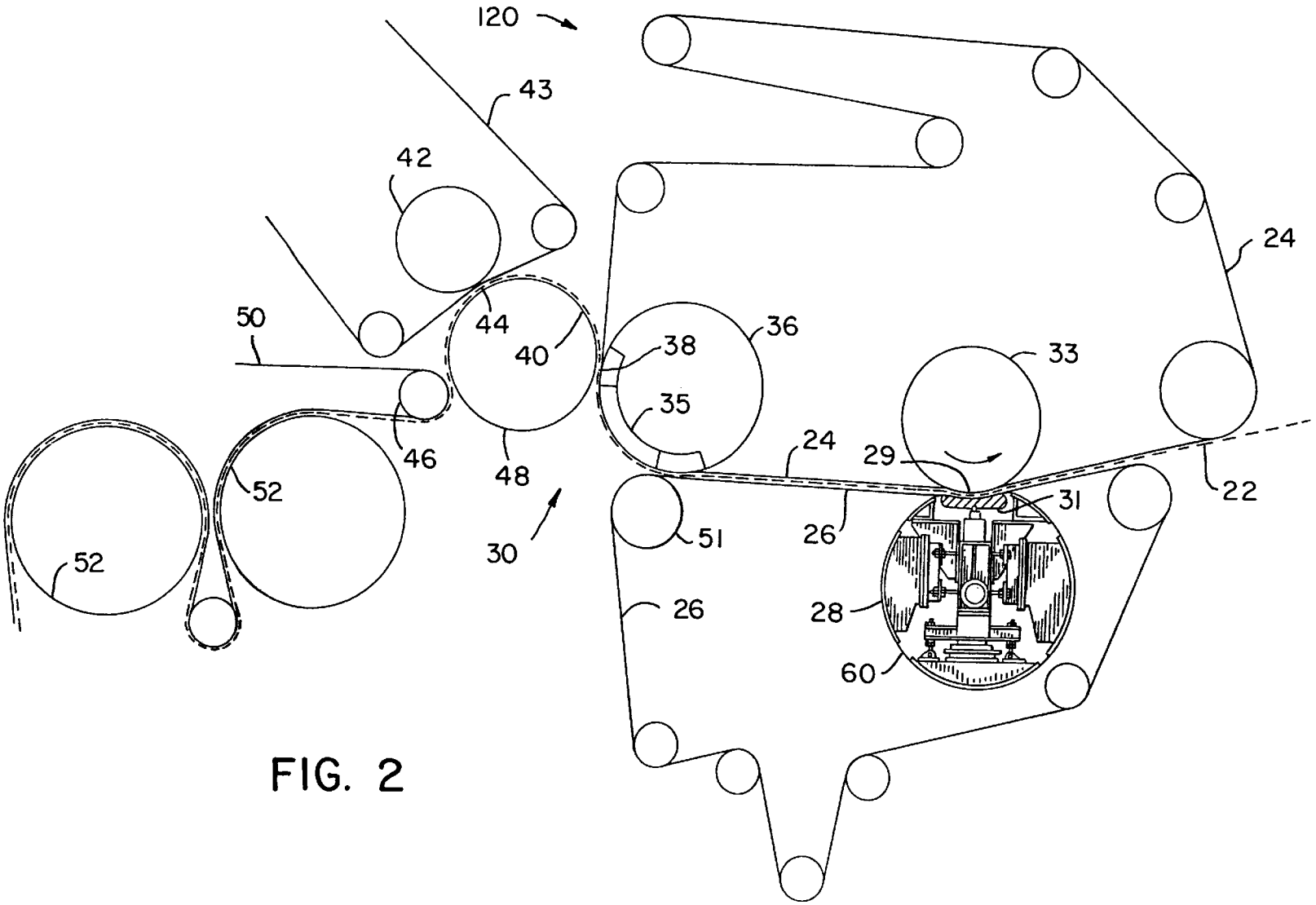
FIG. 2 is a schematic view of the pressing section of FIG. 1 where the bottom press roll has been removed.
Figure 3:
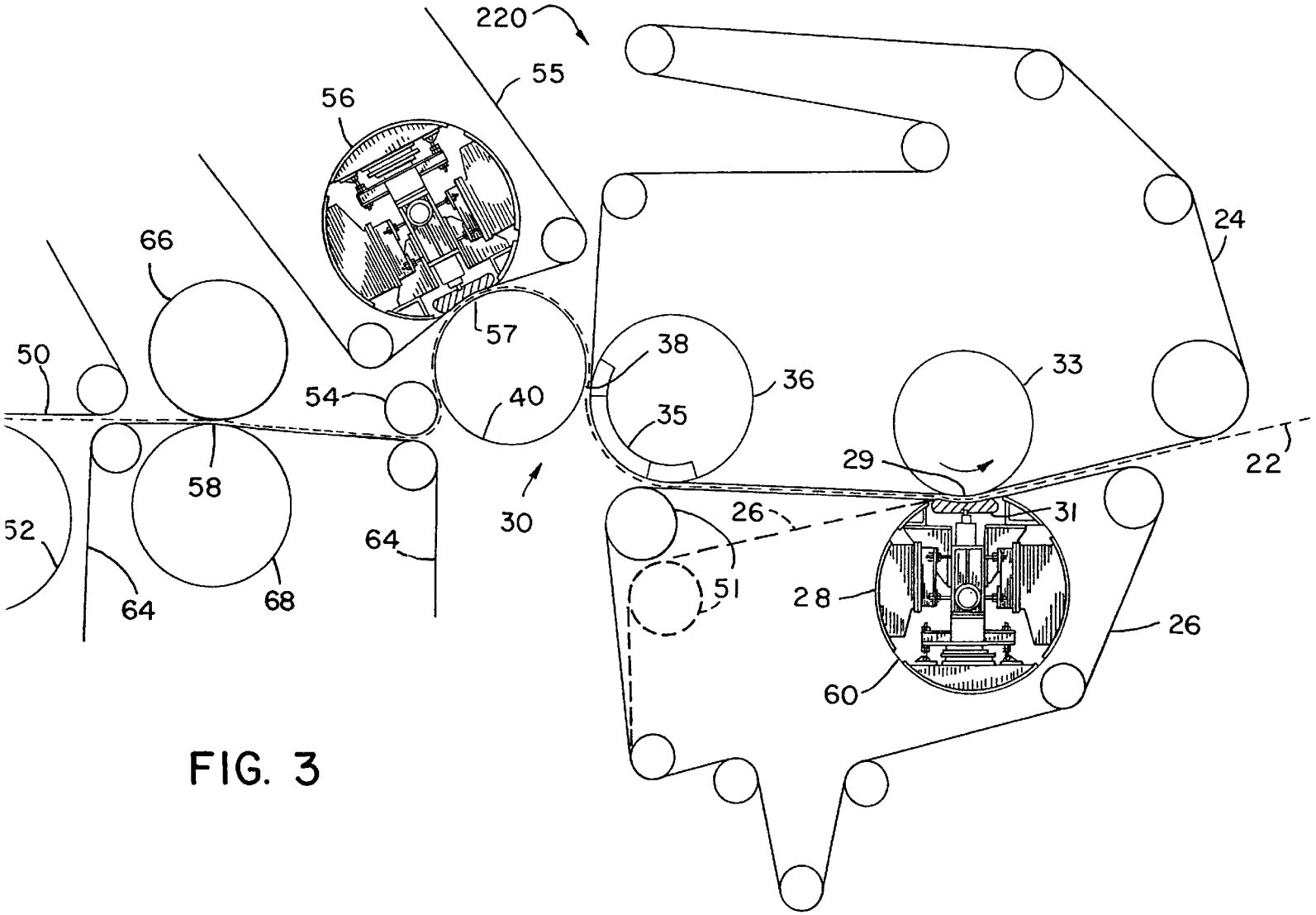
FIG. 3 is a schematic view of an alternative embodiment of the pressing section of this invention

Referring more particularly to FIGS. 1–3, wherein like numbers refer to similar parts, a press section 20 is shown in FIG. 1. The press section 20 receives a web 22 from a forming section (not shown), and the web 22 is supported between an upper felt 24 and a lower felt 26. The web 22 supported on the felts 24, 26 is first pressed by an unheated Extended Nip press 28 having a shoe 31 opposed to a cylindrical backing roll 33. The upper felt 24 forms a loop which encloses the backing roll 33 and the suction roll 36. The bottom felt forms a loop which includes the Extended Nip press 28 and the bottom roll 32 and a turning roll 27.

The Extended Nip press 28 is followed by a conventional three nip press 30 also called a Tri-Nip press such as is available from Beloit Corporation of Beloit, Wis.—see for example U.S. Pat. No. 4,556,451 to Donald A. Ely and U.S. Pat. No. 4,257,844 to Arnold J. Schmitt which, are incorporated herein by reference.

The Tri-Nip press 30 has a suction roll 36 which forms nips 34, 38 with a bottom roll 32 and a center roll 40. The bottom roll 32 forms a first press nip 34 with a suction roll 36. The roll 36 forms a second press nip 38 with a downstream center roll 40. The roll 36 has a three part gland 35 which holds the web 22 on the top felt 24 while the bottom felt 26 leaves the roll 36 and the web 22 at the turning roll 51. The gland 35 also aids in the transfer of the web 22 to the center roll 40. A top roll 42 with a second top felt 43 forms a third nip 44 with the center roll 40. A roll 46 draws the web 22 off the surface 48 of the center roll 40 and onto the first dryer felt 50 which wraps the web 22 onto a dryer roll 52.

The press section 20 is especially useful for processing a web formed of 100 percent tropical hardwood fiber. Tropical hardwood fibers are of relatively low strength and are contaminated by resinous materials which can cause the web to stick to the center roll of a conventional Tri-Nip press. The placement of an Extended Nip press 28 in front of the Tri-Nip press 30 has at least three benefits to the web 22 being formed.

First, by pressing the web 22 when it has a high water content of approximately 80 percent, the hydrodynamic forces of the water support a large portion of the nip loads so the web 22 moving through the nip 29 experiences densification mainly adjacent to its outer surfaces. In this way the web 22 is dewatered without significant compaction, thus enhancing the bulk properties of the paper formed. The second benefit of the Extended Nip press 28 is that it functions to reduce the tendency of the web 22 to stick to the center roll surface 48. By reducing the water content of the web 22 the tendency of the web 22 to stick to the roll surface 48 is reduced because of the lower adhesion of a dry web to a smooth surface like the surface 48 of the central roll 40.

The higher initial dryness of the web 22 as its leaves the Extended Nip press 28 means that the three press nips making up the Tri-Nip press can operate with lower pressures and thus not create as intimate a contact between the web 22 and the roll surface 48.

The reduction in pressure used in the second and third nips reduces the two-sidedness of the web 22. When the web 22 is removed from the center roll 40 by the roll 46 it must be pulled from the surface by web tension. This tension is produced by the greater velocity of the roll 46 and the dryer felt 50. The tension causes the web to stretch which lowers its strength and decreases its bulk. By reducing the adhesion of the web 22 to the center roll 40 the amount of tension necessary to peel the web 22 from the surface 48 of the center roll 40 is significantly reduced.

To reduce rewetting it may be beneficial to pull the bottom felt away from the web 22 as soon as the web 22 exits the nip 29 of the Extended Nip press 28, as shown by dashed line 26 and roll 51 in FIG. 3. Where the bottom felt 26 is pulled away, the web 22 needs to be held against the upper felt 24 by a suction box 24A positioned over the upper felt 24. The roll 32 is not required in this arrangement.

Where the web contains significant filler, for example 30 percent ash, the top and bottom felted Extended Nip press can increase the retention of the filler and increase the amount of filler held near the surface of the web 22. An Extended Nip press 28 removes water from the web 22 more slowly than a conventional press because the resident time in the nip 29 is longer. The less rapid removal of the water contained in the web 22 means the flow of water from the web 22 takes place at a lower velocity. This lower velocity in turn means that less filler is carried along with the water as the water is forced from the web 22. Alternatively, as shown in the apparatus 220, shown in FIG. 3, where high filler contents are incorporated in the web 22, a fourth conventional press 58 after the third press 57 of the Tri-Nip press 30 will significantly improve paper finish. A roll 54 effects the transfer of the web 22 from the center roll 40 to the fourth press 58. The fourth press 58 is necessary where the third press has been replaced by an Extended Nip 57 in a press 56 in order to reduce the two-sidedness of the web 22.

The arrangement illustrated in FIGS. 1–3 uses a Tri-Nip press as a starting point. The Tri-Nip press is modified by replacing the bottom roll with an Extended Nip press 28 as shown in FIG. 2. Because the press 28 will not fit where the bottom roll of a Tri-Nip is located it must be spaced from the suction roll 36 as shown in FIG. 2. If additional pressing capability is required a bottom roll 32 can be reinstalled as shown in FIG. 1 to form a first or bottom press 34 with the suction roll 36.

As shown in the assembly 220 in FIG. 3, if still greater drying capability is needed an Extended Nip press 28 can be installed on the center roll 40 to form an inverted nip press 56. The greater dwell time of the inverted nip 57 of the press 56 in pressing the web 22 against the center roll 40 can increase the two-sidedness of the web 22 necessitating the use of a fourth press 58 to improve the one-sidedness of the web 22. For maximum drying capability in the assembly 220, the first nip of the Tri Nip press is an Extended Nip press 28. Alternatively, a conventional press 34 may be used to define the first nip of the Tri-Nip press, by employing a bottom roll 32 with the suction roll 36 as shown in FIG. 1.

The pressing section 20 of FIG. 1 and the pressing section 120 of FIG. 2 and the pressing section 220 of FIG. 3 can be configured so that a single papermaking machine can be modified to accept all three pressing sections 20, 120, 220. In this way, where a new papermaking machine is designed and installed for use with a particular feed stock of fiber, such as tropical hardwood pulp, the press section may initially be configured like press section 120 shown in FIG. 2. Then if conditions require additional pressing capability, this capability can be added in stages. First, as shown in FIG. 1, the first press 34 of the Tri-Nip can be installed by adding the bottom roll 32. If still further pressing is required the Extended Nip press 28 can be moved or added in an inverted position on the center roll 40. In this position the EDP press forms an inverted press 56 with an upper felt 55 as shown in FIG. 3. By adding a fourth press 58 the surface finish produced by the Extended Nip press 58 in the inverted position is balanced. If still more pressing is required a second Extended Nip press may be installed in the leading position as shown in FIG. 3.

The Extended Nip presses 28 shown in FIGS. 1–3 will preferably be as shown with a closed blanket 60 which rides on a hydrodynamic film created between a shoe 31 and the blanket 60. However an open blanket type Extended Nip press may be used. It should be noted that the web extends from the first nip at the Extended Nip press to the Tri-Nip press and through the various nips of the Tri-Nip press with no open draw.

In FIG. 3, where a fourth press 58 is positioned to improve the one-sidedness of the web 22, a fourth press 58 bottom felt 64 is used to support the web 22 between the central roll 40 and the dryers 52. The fourth press 58 employs an upper press roll 66 and a lower backing roll 68. Alternatively, the fourth press may be an Extended Nip press.

In the assembly 120 of FIG. 2 the suction roll 36 forms only a single press nip 38 and is thus subjected to less stress then the suction roll 36 of the assembly 20, shown in FIG. 1, which forms two press nips. Lower stress can lead to increased life for the roll shell. A single press nip on the suction roll 36 reduces the susceptibility to the formation of shadow marking at high ash levels. In addition where a single press nip is formed with the suction roll 36 reduced vacuum is required on the roll 36.

The center roll 40 is of conventional design and may employ an ultra rock ceramic cover. If the third nip employs a press of the Extended Nip type the center roll 40 should be of the type which is supported by hydraulic pistons internal to the roll 40.

It should be understood that wherein the pressing sections 20, 120, 220 shown in FIGS. 1–3 are particularly useful in overcoming problems associated with pressing webs formed from 100 percent tropical hardwood fibers and webs containing a large percentage of fillers, the pressing sections described herein can be used with a wide range of paper webs and papermaking machines.

It should also be understood that depending on the width of the pressing section the various rolls may be of the crown controlled type. Furthermore, although a Beloit Corporation Extended Nip press has been discussed herein, other makes of press having a concave shoe engaging the web with the backing roll may be employed.

It is understood that the invention is not limited to the particular construction and arrangement of parts herein illustrated and described, but embraces such modified forms thereof as come within the scope of the following claims.

I claim:

1. A method for pressing a paper web made from one hundred percent tropical hardwood fibers, the method comprising:

removing a web of one hundred percent tropical hardwood paper pulp from a forming screen;

passing the web under a suction pickup roll so that the web contains about 20 percent fiber by weight;

supporting the web between an upper felt and a lower felt;

prepressing the web in an extended nip press between the upper felt and the lower felt to dewater and reduce the stickiness of the web of tropical hardwood paper pulp;

reducing rewetting of the web by pulling the bottom felt away from the web as the web exits the extended nip press;

maintaining the web in contact with the top felt with suction prior to entering a second press nip;

transferring the web to the second nip having a suction roll forming the second nip with a downstream center roll, the suction roll for holding the web on the top felt as the web comes into direct contact with the center roll;

transferring the web to a third press nip formed by a top roll and the center roll, the top roll having a second top felt in contact with the web;

drawing the web from the surface of the center roll;

transferring the web to a first dryer felt; and wrapping the web onto a dryer roll with the first dryer felt.

2. The method of claim 1 further comprising the step of transferring the web from the nip to a press nip, and wherein said third nip is an extended nip press.

* * * * *